US009723403B2

(12) United States Patent
McElveen

(10) Patent No.: US 9,723,403 B2
(45) Date of Patent: Aug. 1, 2017

(54) WEARABLE DIRECTIONAL MICROPHONE ARRAY APPARATUS AND SYSTEM

(71) Applicant: James Keith McElveen, Mount Pleasant, SC (US)

(72) Inventor: James Keith McElveen, Mount Pleasant, SC (US)

(73) Assignee: Wave Sciences LLC, Charleston, SC (US)

( * ) Notice: Subject to any disclaimer, the term of this patent is extended or adjusted under 35 U.S.C. 154(b) by 0 days.

(21) Appl. No.: 15/280,343

(22) Filed: Sep. 29, 2016

(65) Prior Publication Data

US 2017/0094407 A1 Mar. 30, 2017

Related U.S. Application Data

(60) Provisional application No. 62/234,281, filed on Sep. 29, 2015.

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01); *H04R 2201/023* (2013.01); *H04R 2430/20* (2013.01)

(58) Field of Classification Search
CPC .. H04R 3/005; H04R 1/326; H04R 2201/023; H04R 2430/20
See application file for complete search history.

(56) References Cited

U.S. PATENT DOCUMENTS

| | | | | |
|---|---|---|---|---|
| 5,906,004 | A * | 5/1999 | Lebby | A41D 31/00 139/425 R |
| 6,080,690 | A * | 6/2000 | Lebby | A41D 31/00 139/420 R |
| 7,877,121 | B2 | 1/2011 | Seshadri et al. | |
| 8,111,582 | B2 | 2/2012 | Beck et al. | |
| 9,025,782 | B2 * | 5/2015 | Visser | H04R 3/005 381/23.1 |
| 2004/0114777 | A1 * | 6/2004 | Aubauer | H04B 1/385 381/333 |
| 2011/0317858 | A1 | 12/2011 | Cheung | |

(Continued)

FOREIGN PATENT DOCUMENTS

| | | | |
|---|---|---|---|
| EP | 2736272 | A1 | 5/2014 |
| WO | WO2011087770 | A2 | 7/2011 |

*Primary Examiner* — Brenda Bernardi
(74) *Attorney, Agent, or Firm* — Gregory Finch

(57) ABSTRACT

A wearable, shoulder-mounted microphone array apparatus and system used as a bi-directional audio and assisted listening device system. The present invention advances hearing aids and assisted listening devices to allow construction of a highly directional audio array that is wearable, natural sounding, and convenient to direct, as well as to provide directional cues to users who have partial or total loss of hearing in one or both ears. The advantages of the invention include simultaneously providing high gain, high directivity, high side lobe attenuation, and consistent beam width; providing significant beam forming at lower frequencies where substantial noises are present, particularly in noisy, reverberant environments; and allowing construction of a cost effective body-worn or body-carried directional audio device.

20 Claims, 7 Drawing Sheets

(56) References Cited

U.S. PATENT DOCUMENTS

| | | | | |
|---|---|---|---|---|
| 2012/0177219 | A1* | 7/2012 | Mullen | F41G 3/147 381/92 |
| 2012/0230526 | A1 | 9/2012 | Zhang | |
| 2013/0101136 | A1* | 4/2013 | McElveen | H04R 3/005 381/92 |

* cited by examiner

WEARABLE DIRECTIONAL MICROPHONE ARRAY APPARATUS AND SYSTEM

RELATED APPLICATIONS

This application claims the benefit of U.S. Provisional Application 62/234,281, filed Sep. 29, 2015, hereby incorporated by reference.

FIELD

The present invention is in the technical field of directional audio systems, in particular, microphone arrays used as bi-directional audio systems and microphone arrays used as assisted listening devices and hearing aids.

BACKGROUND

Directional audio systems work by spatially filtering received sound so that sounds arriving from the look direction are accepted (constructively combined) and sounds arriving from other directions are rejected (destructively combined). Effective capture of sound coming from a particular spatial location or direction is a classic but difficult audio engineering problem. One means of accomplishing this is by use of a directional microphone array. It is well known by all persons skilled in the art that a collection of microphones can be treated together as an array of sensors whose outputs can be combined in engineered ways to spatially filter the diffuse (i.e. ambient or non-directional) and directional sound at the particular location of the array over time.

The prior art includes many examples of directional microphone array audio systems mounted as on-the-ear or in-the-ear hearing aids, eye glasses, head bands, and necklaces that sought to allow individuals with single-sided deafness or other particular hearing impairments to understand and participate in conversations in noisy environments. The various challenges of the implementing directional audio systems into wearable garments include awkward or inflexible mounting of the microphone array, hyper-directionality, ineffective directionality, and inconsistent performance. When using the audio system in its bi-directional capacity and speaking into the microphone, it becomes crucial to pinpoint the sound source with accuracy in order to filter out the ambient noise surrounding the speaker. This is especially important for individuals working in high ambient noise conditions, such as flight decks or airport tarmacs for example.

A review of the prior art reveals the following wearable microphone array devices. U.S. Pat. No. 7,877,121 issued to Seshadri et al. discloses at least one wearable earpiece and at least one wearable microphone.

U.S. Pub. No. 2011/0317858 to Cheung discloses a hearing aid frontend device for frontend processing of ambient sounds. The frontend device is adapted for wearing use by a user and comprises first and second sound collectors adapted for collecting ambient sound with spatial diversity.

World Pat. No. 8,111,582 issued to Elko discloses a microphone array, having a three-dimensional (3D) shape, has a plurality of microphone devices mounted onto (at least one) flexible printed circuit board.

World Pat. No. 2003039014 issued to Burchard et al. discloses a piece of garment having an electronic circuit that comprises at least one unit for data acquisition and/or data output and a transmission interface.

U.S. Pat. No. 20120230526 issued to Zhang, Tao discloses a first microphone to produce a first output signal; a second microphone to produce a second output signal; a first directional filter; a first directional output signal; a digital signal processor; a voice detection circuit; a mismatch filter; a second directional filter; and a first summing circuit.

While a multitude of bidirectional microphone systems are present in the prior art, no prior art solution exists to provide a bidirectional microphone system that can be incorporated into a wearable garment, calibrate directionality and time delay at an individual microphone level, and process a high definition digital audio output of a user's voice in high ambient noise environments. Through applied effort, ingenuity and innovation, Applicant has developed a solution embodied by the present disclosure to improve upon the challenges associated with bidirectional microphones in wearable garments.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is an apparatus comprising a wearable garment having a left shoulder portion and a right shoulder portion; a first plurality of sensors disposed on the left shoulder portion of the wearable garment, the first plurality of sensors comprising an array; a second plurality of sensors disposed on the right shoulder portion of the wearable garment, the second plurality of sensors comprising an array; and, an audio processing module, the audio processing module being operable to combine a first stage beamformed audio input from the first plurality of sensors and a first stage beamformed audio input from the second plurality of sensors to render an audio output.

Another object of the present disclosure is an apparatus comprising a wearable garment having a left shoulder portion and a right shoulder portion; a first plurality of sensors comprising an array disposed on the left shoulder portion of the wearable garment; a second plurality of sensors comprising an array disposed on the right shoulder portion of the wearable garment, each sensor in the first plurality of sensors and the second plurality of sensors having an individually calibrated directivity pattern and time delay corresponding to a source location of a user's voice; and, an audio processing module operably engaged with the first plurality of sensors and the second plurality of sensors through an electrical bus, wherein the audio processing module comprises one or more processors operable to combine a first stage beamformed audio input from the first plurality of sensors and a first stage beamformed audio input from the second plurality of sensors to render a digital audio output.

Still another object of the present disclosure is a directional microphone array system comprising a wearable garment having a left shoulder portion and a right shoulder portion; a first plurality of sensors comprising an array disposed on the left shoulder portion of the wearable garment; a second plurality of sensors comprising an array disposed on the right shoulder portion of the wearable garment, each sensor in the first plurality of sensors and the second plurality of sensors having an individually calibrated directivity pattern and time delay corresponding to a source location of a user's voice; a reference microphone disposed on a portion of the wearable garment, the reference microphone having a directivity pattern operable to receive an acoustic input from one or more ambient sound sources; an audio processing module operably engaged with the first plurality of sensors, the second plurality of sensors, and the reference microphone through an electrical bus, wherein the audio processing module comprises beamforming and signal separation circuitry, and one or more processors; and, an output device operably engaged with the audio processing module.

Specific embodiments of the present disclosure provide for a directional microphone array system wherein each sensor in the first plurality of sensors and the second plurality of sensors is operable to calibrate a directivity pattern according to the directionality of a common signal between overlapping beams among other sensors in the first plurality of sensors and the second plurality of sensors in response to a user's voice audio input; and wherein each sensor in the first plurality of sensors and the second plurality of sensors is operable to calibrate a time delay according to the time delay of a common signal between overlapping beams among other sensors in the first plurality of sensors and the second plurality of sensors in response to a user's voice audio input.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BREIF DESCRIPTION OF DRAWINGS

The above and other objects, features and advantages of the present disclosure will be more apparent from the following detailed description taken in conjunction with the accompanying drawings, in which.

Figure 3A:
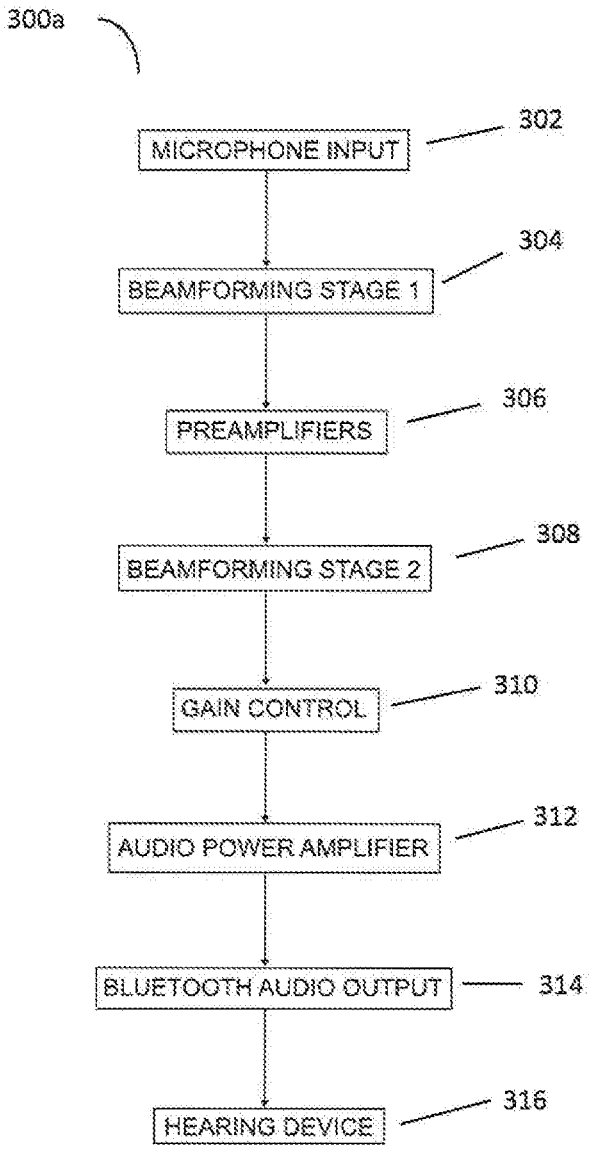
Figure 3B:
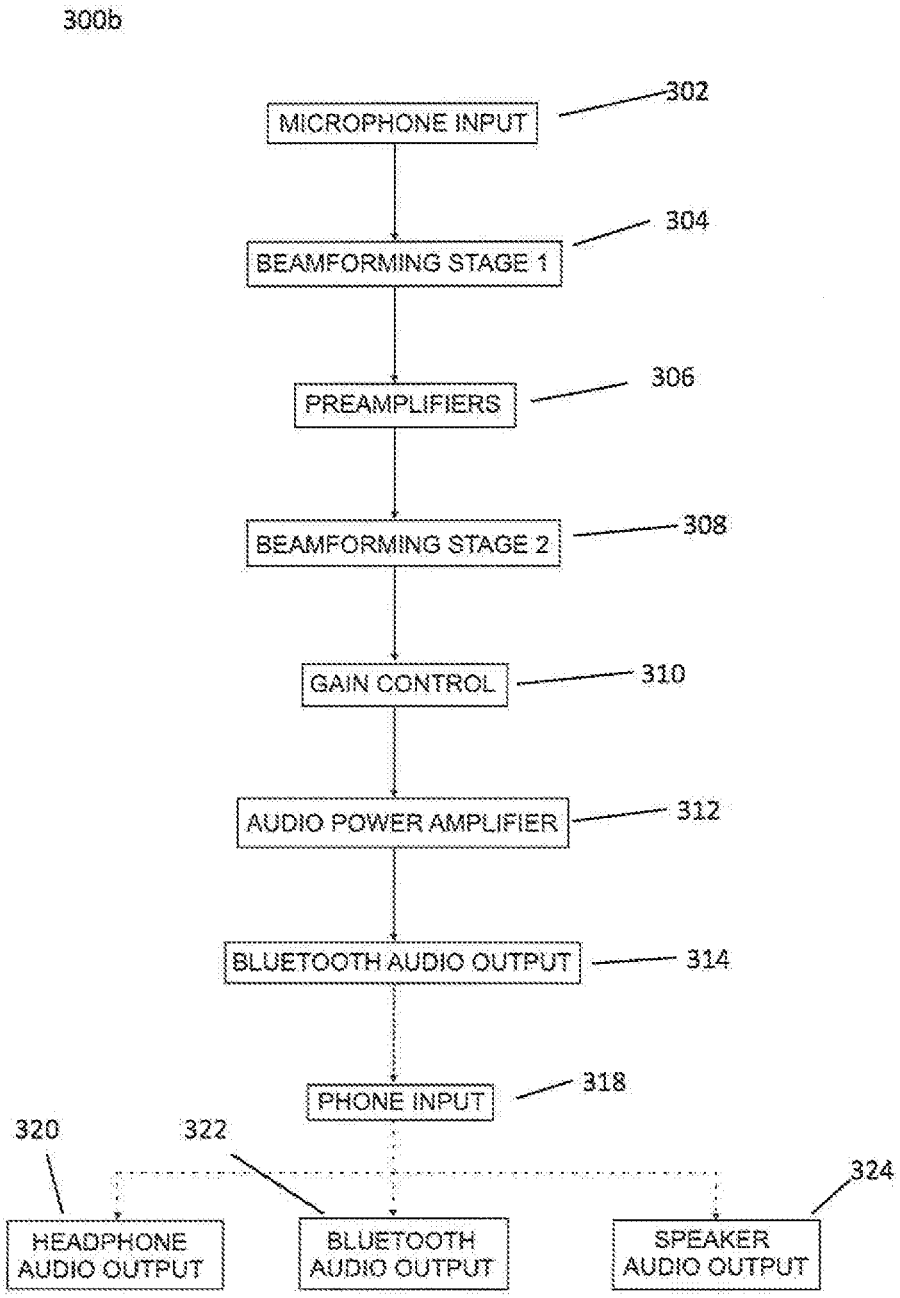
Figure 5:
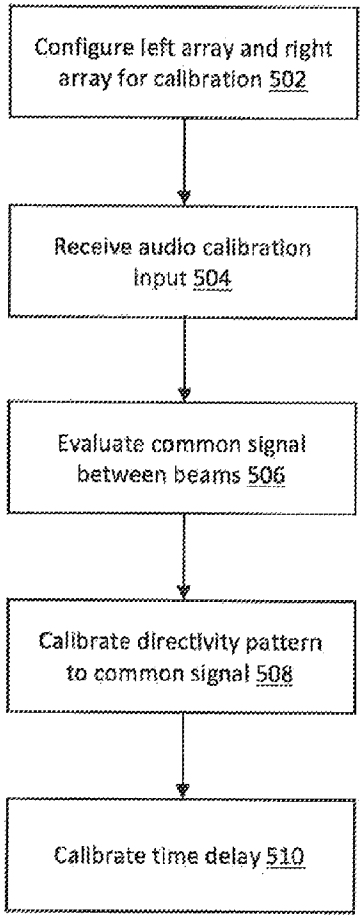
Figure 4:
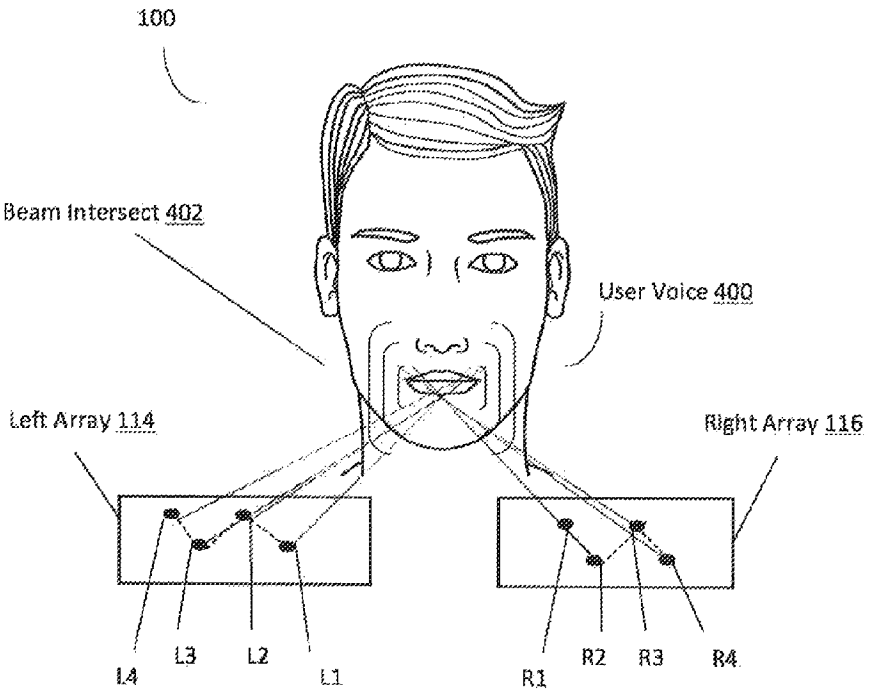
Figure 6:
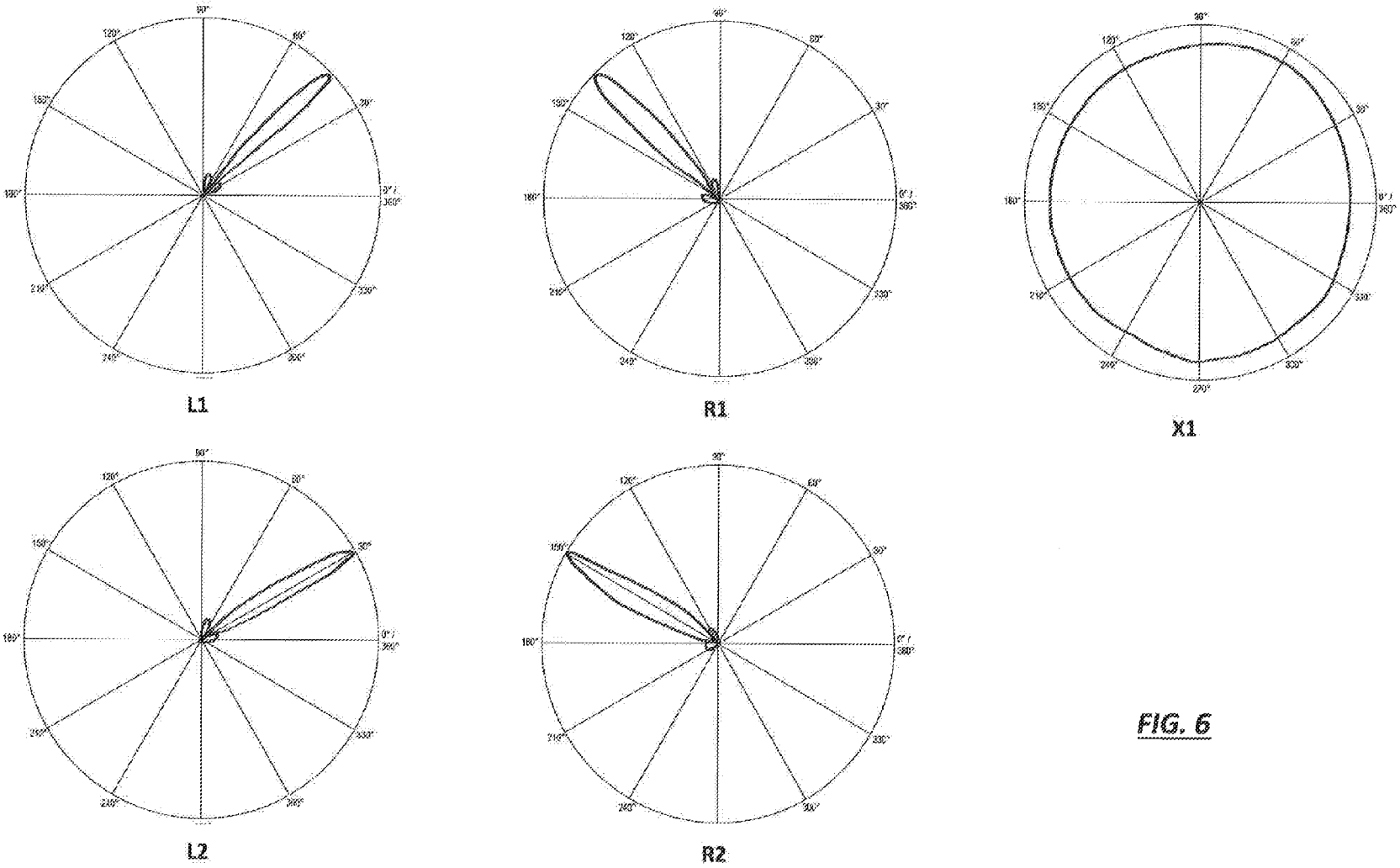
Figure 7:
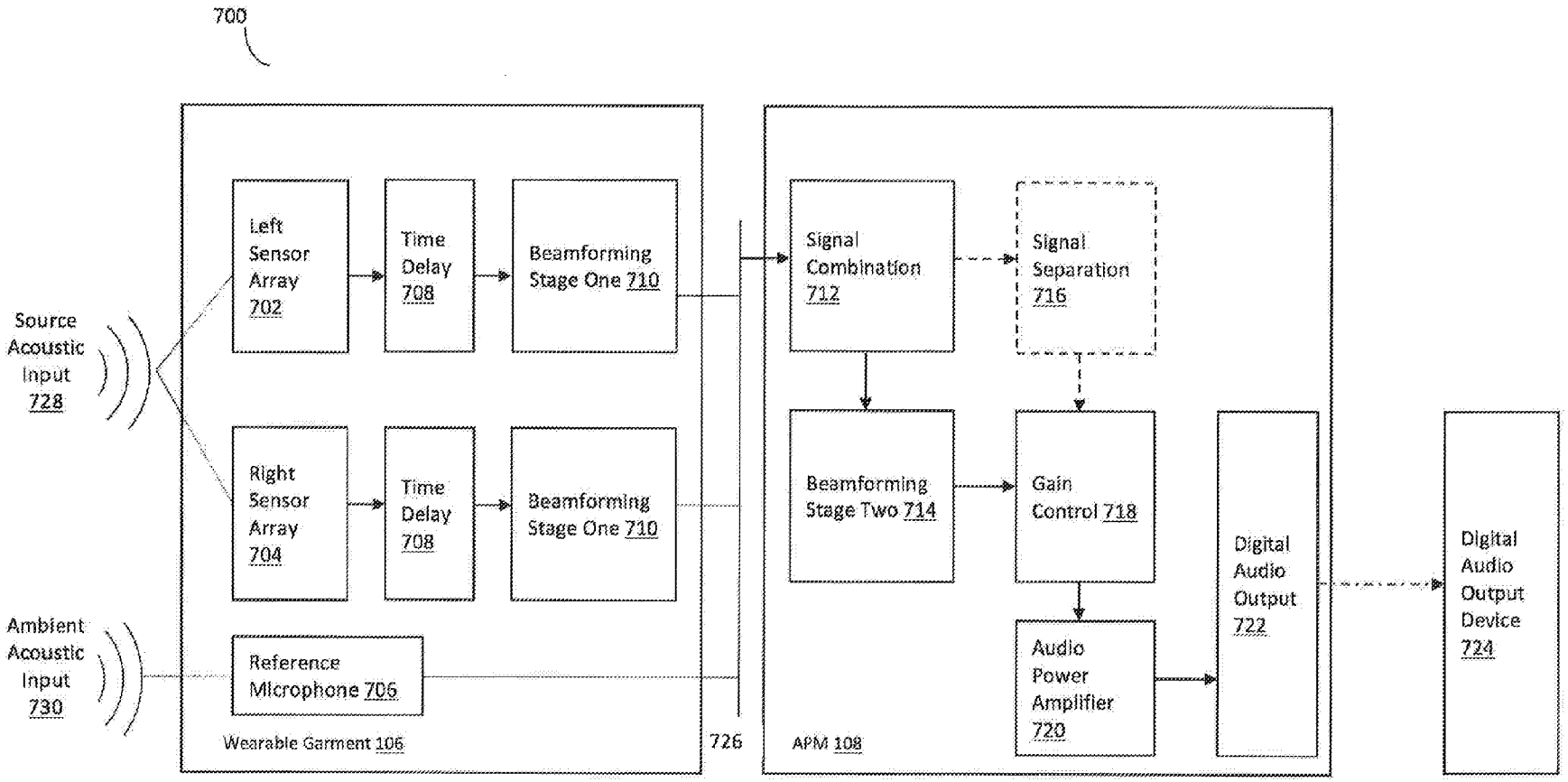

FIG. 3*a* is a functional block diagram showing the functional steps of a bi-directional microphone array system, according to an embodiment;

FIG. 3*b* is a functional block diagram showing the functional steps of a bi-directional microphone array system, according to an embodiment;

FIG. 4 is a functional diagram illustrating microphone beam intersects, according to an embodiment;

FIG. 5 is functional block diagram showing the functional steps of microphone calibration, according to an embodiment;

FIG. 6 is a log plot of directivity patterns of selected microphones in a left array and a right array, according to an embodiment; and, FIG. 7 is system diagram of a bi-directional microphone array system, according to an embodiment.

DETAILED DESCRIPTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

Embodiments of the present disclosure provide for a bi-directional microphone array integrated into a garment to be worn by a user. Embodiments of the current disclosure enable a user to capture audio input from the environment as well as the user's voice, both simultaneously and independently, and process the audio input to be rendered for the user's telephone, hearing aid, or assistive listening device. Audio input captured by the microphone array may be rendered as an audio output for applications such as helping hearing impaired users improve hearing various settings; enabling users to utilize a smartphone or other mobile communication device as an assisted listening device; and, enabling users to integrate in-ear assistive listening devices or hearing aids with their smartphone or other mobile communication device for two-way communication. Users may also use embodiments of the present disclosure as a body-worn, hands-free microphone apparatus.

Figure 1:
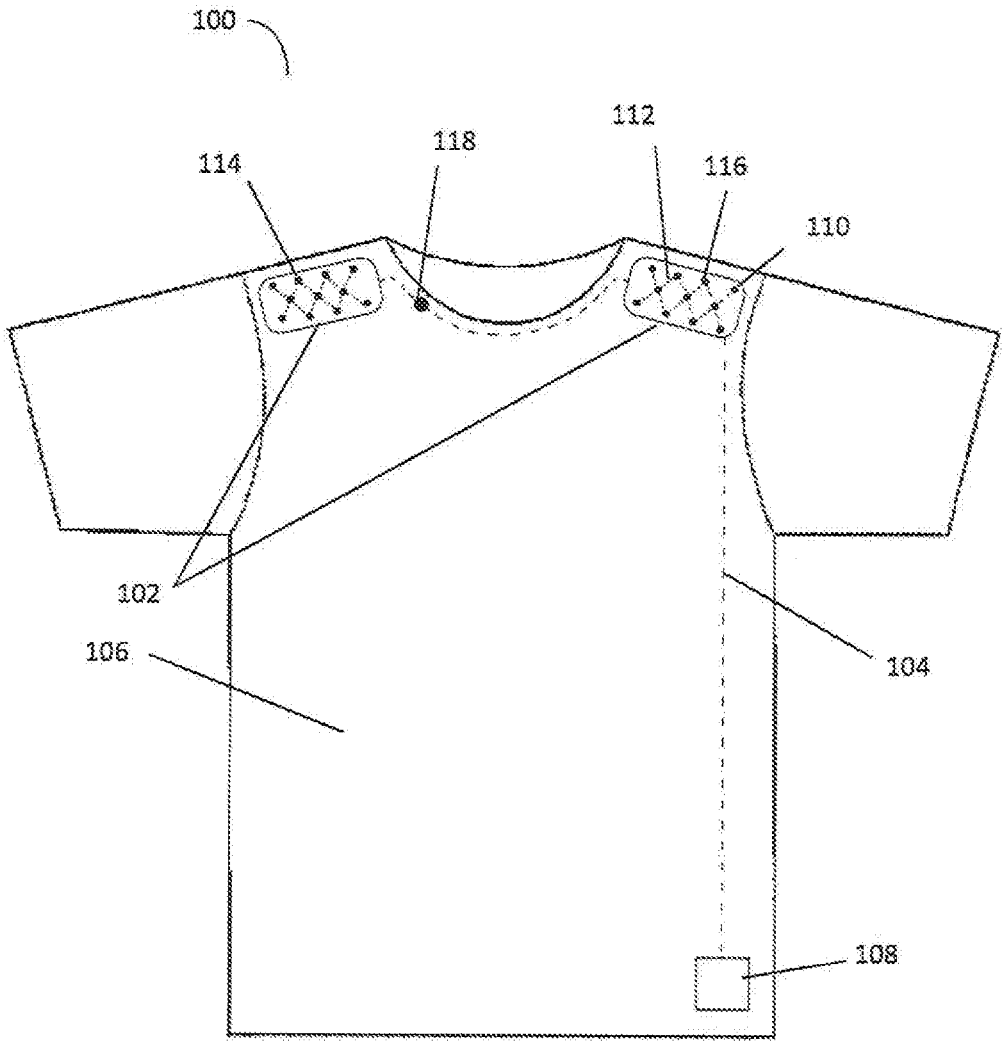
FIG. 1 is a perspective view of a shoulder mounted a bi-directional microphone array apparatus, according to an embodiment.

Referring now to FIG. 1, a perspective view of a wearable bi-directional microphone array apparatus is shown. According to an embodiment, a wearable bi-directional microphone array apparatus 100 is comprised of a microphone array 102, which is further comprised of right shoulder array 116 and a left shoulder array 114. Microphone array 102 is incorporated into a wearable garment 106. Right shoulder array 102 and a left shoulder array 114 may be surface mounted or embedded within garment 106. In a preferred embodiment, right shoulder array 102 and a left shoulder array 114 are coupled to a right and left shoulder area, respectively, of garment 106, such that when worn, right shoulder array 102 and a left shoulder array 114 are positioned on an anterior region of the wearer's torso above the breast bone but not higher than the collar bone. In an alternative embodiment, microphone array 102 is coupled to a shoulder area of garment 106 at or near the collar bone and arranged such that a back pack or shoulder strap may be worn without obscuring microphone array 102. In this embodiment, microphone array 102 could be embedded in the straps of a backpack or hydration pack; and may include one or more loudspeakers to act as a listening device for the user. The one or more loudspeakers can also be beamsteered as an array to direct more energy to the user's ears rather than in other directions where it will be wasted.

Referring again to the preferred embodiment, microphone array 102 may be disposed upon one or both shoulders of garment 106. Microphone array 102 may be comprised of a plurality of microphones 110 operably interconnected by a plurality of electrical connections 112. Microphones 110 may also include acoustic sensors, acoustic renderers, and digital transducers. Electrical connections 112 may be comprised of individual electrical wires, or maybe comprised of nanotechnology materials or other conductive fabrics or fibers to both mount and serve as electrical connections to microphones 110. Sound captured by microphone array 102 may be sent to an electronics module or audio processing module (APM) 108 through an electrical bus 104. Electrical bus 104 may be incorporated into the stitching along the collar and side of garment 106 to reduce discomfort for user when worn. APM 108 includes circuitry and other components to enable it to perform audio processing functions. Audio processing functions may include time delay, signal separation, signal combination, second stage beamforming, gain or volume control, audio filtering, and/or signal output via a wireless interface such as BLUETOOTH or magnetic-inductive hearing loops for wireless communications to tele-coil equipped listening devices. Microphones 110 may be wired in a zonal configuration according to directivity pattern of individual microphones configured to capture directional audio input from either a user's speech or environmental audio input. Microphones 110 may be individually operable to deliver an arriving acoustic signal output to APM 108, or may be configured to pre-combine arriving acoustic signals in zones to create a modified directivity pattern of the microphone array to deliver an arriving acoustic signal output to APM 108. Microphone apparatus 100 may include a reference microphone 118, and APM 108 may include a general reference microphone channel that is not beamformed and provides a representation of the sounds produced by sources other than the target source reaching microphone array 102 or its vicinity. Reference microphone 118 may be incorporated into microphone array 102 or may be independent of microphone array 102. Reference microphone 118 may be utilized in a general situational awareness mode (i.e. omnidirectional) and as a reference of ambient noise for noise reduction filtering. The situational awareness mode may provide situational acoustic data for the user, or may process situational acoustic data on a remote server, such that reference microphone 118 is operable to process the auditory environment to recognize the sounds or otherwise classify the type of environment. Microphone array 102 may include external speakers that are beamformed to the direction of one or both of the wearer's ears to act as an integrated listening device.

Figure 2:
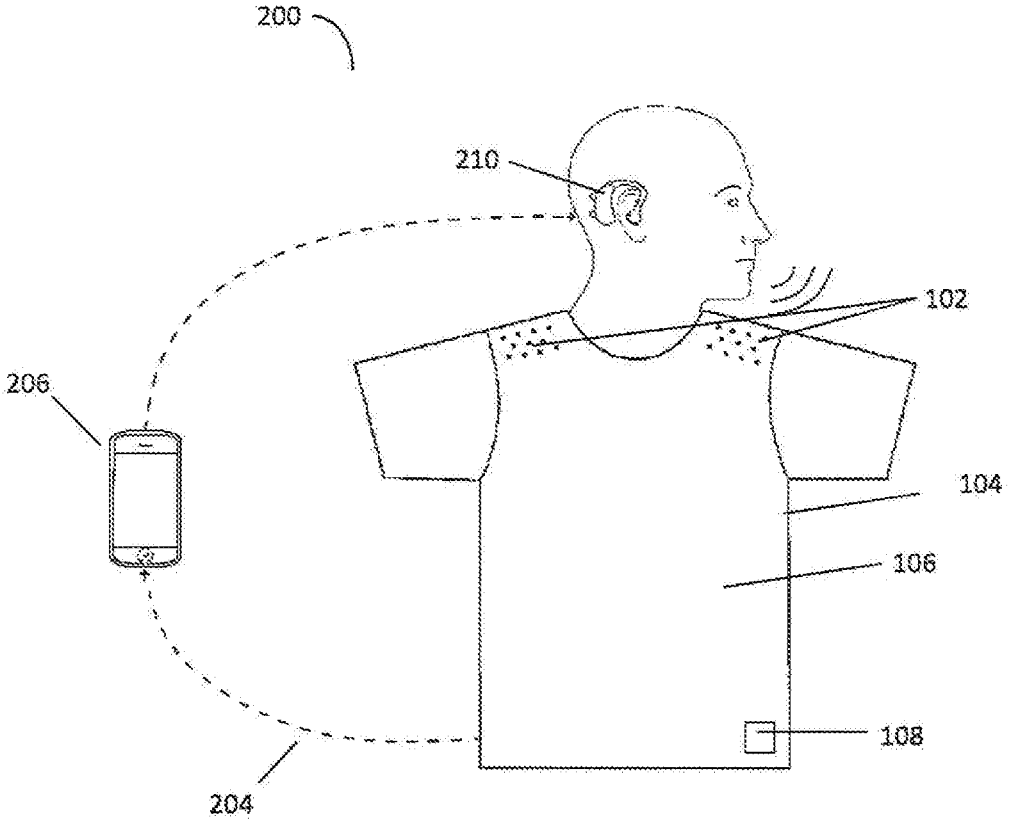
FIG. 2 is a perspective view of a shoulder mounted a bi-directional microphone array system, according to an embodiment.

Referring now to FIG. 2, a perspective view of a shoulder mounted bi-directional microphone array system 200 is shown. According to an embodiment, microphone array 102 captures sound from one or more target sources, processes it to reduce sounds arriving from directions other than the acoustic corollary of field-of-view, and outputs the directional sounds for a user. Acoustic signals are beamformed in single or multiple groups in a first stage of beamforming directly on electrical bus 104 into single or multiple channels. In an embodiment, audio signals from the first stage of beamforming may be delivered to audio processing module 108. In an embodiment, a pre-beamformed channel or channels may have engineered time delay(s) applied and then the channels are processed again in a second stage of beamforming executing on audio processing module 108 to accomplish or help to accomplish steering of the pick-up pattern (beam), signal cancelation, and/or signal separation. Linear or automatic gain control (which may also include dynamic range control and similar amplitude filtering) and audio frequency filtering may then be applied selectively prior to the directional audio being produced at an audio output 204. In an alternative embodiment, audio processing module 108 may be excluded from microphone apparatus 100. Acoustic signals may be beamformed in single or multiple groups on electrical bus 104 into single or multiple channels and rendered directly as an audio output.

In a preferred embodiment, audio output 204 is communicated from audio processing module 108 to a user's smartphone 206. Audio output 204 may be received as a BLUETOOTH audio input by smartphone 204. Alternatively, audio output 204 may be communicated directly to a hearing aid or assistive listening device 210. Smartphone 204 may be used to relay audio output 204 to hearing aid or assistive listening device 210, and may relay user's voice via audio output 204 through a phone call over a cellular or voice over internet protocol network, such that the user may substitute the internal microphone of smartphone 206 for wearable bi-directional microphone array apparatus 100. The user may also substitute the speaker of the smartphone 206 by using the loudspeakers (one, two, or arrayed to be directional toward ears) through a BLUETOOTH connection from phone to electronics module of wearable bi-directional microphone array apparatus 100.

Referring now to FIGS. 3*a* and 3*b*, a functional block diagram showing the functional steps of a bi-directional microphone array system is shown. FIGS. 3*a* and 3*b* illustrate system 200 (as shown in FIG. 2) acquires the sounds from the environment, processes them to filter out directional sounds of interest, and outputs the directional (beamformed) sounds for the user. In more detail, a plurality of microphones on the wearer's right shoulder and a plurality of microphones on the wearer's left shoulder capture the arriving acoustic input at the array 302. The resulting microphone signals are beamformed in groups (e.g. zonal configuration) in a first stage of beamforming 304 directly on an electrical bus of a microphone array into multiple channels. The pre-beamformed channels are then amplified 306 and then beamformed again in a second stage of beamforming 308. Linear or automatic gain control (including frequency filtering) 310 and audio power amplification 312 are then applied selectively prior to the directional audio being produced at a wireless or BLUETOOTH audio output level 314. According to FIG. 3*a*, wireless or BLUETOOTH audio output is communicated to a hearing device 316 for auditory output by a user. As in FIG. 3*b*, wireless or BLUETOOTH audio output may be communicated to a smartphone as an audio input 318, which may relay the audio input to one or more output channels, including headphone audio output 320, BLUETOOTH audio output 322, and speaker audio output 324.

Other variations on this construction technique include adding successive stages of beamforming; alternative orders of filtering and gain control; use of reference channel signals with filtering to remove directional or ambient noises; use of time or phase delay elements to steer the directivity pattern; the separate beamforming of the two panels so that directional sounds to the left (right) are output to the left (right) ear to aid in binaural listening for persons with two-sided hearing or cochlear implant(s); and the use of one or more signal separation algorithms instead of one or more beamforming stages.

Referring now to FIG. 4, a functional diagram illustrating directivity and calibration methodology of left shoulder array 114 and right shoulder array 116 is shown. According to an embodiment, left shoulder array 114 and right shoulder array 116 are calibrated to steer the directivity of individual microphones on each array to focus tightly formed individual beams to intersect at the source location of a user's voice 400. By calibrating directivity of the microphones in the wearable garment, system 100 can be configured to accommodate the unique body size and shape of the wearer and enable optimal directivity to capture the arriving wave front generated by the user's voice 400, while limiting interference from ambient acoustic sources. A time delay is calibrated on each of the microphones to compensate for the varying distances between the microphones and the source location of the user's voice 400, such that the arriving wave front of the user's voice 400 arrives in-phase across all microphones in left array 114 and right array 116.

To illustrate the above concept of individually calibrated directivity and time delay of microphones, FIG. 4 illustrates left array 114 with individual microphones L1, L2, L3, and L4; and right array 116 with individual microphones R1, R2, R3, and R4. In a preferred embodiment, left array 114 and right array 116 are comprised of approximately five to fifty microphones; however, for simplicity of illustration, FIG. 4 illustrates left array 114 and right array 116 with four microphones each. It is anticipated that left array 114 and right array 116 could function with a few as a single microphone each; however, fewer microphones will result in decreased performance capabilities of system 100. To calibrate directivity and time delay, microphones L1-4 and R1-4 receive an acoustic input via user's voice 400. The audio processing module (not shown in FIG. 4) processes the resulting input to calculate the common signal across microphones L1-4 and R1-4 to determine the intersect of the beams of each microphone, thereby approximating the location of the user's mouth relative to microphones L1-4 and R1-4. The intersect of the beams of each microphone, and thereby the resulting desired directivity pattern, is computed using a least mean square (LMS) class of algorithms. LMS algorithms are a class of adaptive filter used to mimic a desired filter by finding the filter coefficients that relate to producing the least mean squares of the error signal (difference between the desired and the actual signal). Alternatively, or in addition to one or more LMS algorithms, the common signal between the beam of each may be calculated using various correlation algorithm or even a simple summation algorithm. While LMS algorithms, correlation algorithms, and summation algorithms are preferred, any number of algorithms capable of evaluating a common set of wavelengths across multiple sources is anticipated. The common signal across each microphone in the array is computed by the audio processing module to determine the convergence mean of the individual microphone beams, thereby estimating the source location of the user's voice 400 and the common signal of the user's voice. By calibrating the directivity pattern(s) and time delay of microphones L1-4 and R1-4 according to the convergence mean of the arriving wave front, system 100 configures tight cross beams across microphones in left array 114 and right array 116 to capture the acoustic input of the user's voice with limited interference from ambient acoustic frequencies.

Referring now to FIG. 5, a process flow for calibration of the directivity pattern and time delay of left array 114 and right array 116 further illustrates the calibration concepts discussed in FIG. 4. According to an embodiment, a user configures a left array and a right array for calibration 502. The user may configure left array and right array for calibration through an input on the audio processing module or the array. Once the left array and the right array are configured for calibration, the user delivers a calibration input (the user's speaking voice or an impulsive clicker positioned to be at the user's mouth) to the arrays. The arrays receive the calibration input 504 and the audio processing module evaluates the common signal between the beams of the microphone arrays 506 using an LMS algorithm. The audio processing module calibrates the directivity pattern of the microphones in the left array and the right array according to the convergence mean of the arriving wave front, and the system configures beam directivity across microphones in left array and right array to form tight cross beams that intersect at the location of the user's mouth (i.e. sound source) 508. The audio processing module calibrates the time delay of the microphones in the left array and the right array according to the phase delay of the common signal across each microphone in the array, such that the arriving wave front from the sound source is processed in-phase across each microphone 510. The calibration settings are then fixed for that individual user. The time delay and directivity patterns may be recalibrated to another user to accommodate for the difference in body dimensions between users.

FIG. 6 is a log plot of directivity patterns of selected microphones in a left array and a right array. FIG. 6 illustrates example directivity patterns for the microphones shown in FIG. 4. According to an embodiment, in order to form tight cross beams to intersect at the user's mouth as the desired sound source, microphone L1 may be configured to a beam directivity pattern in the range of about 40 to about 50 degrees; microphone L2 may be configured to a beam directivity pattern in the range of about 25 to about 35 degrees; microphone R1 may be configured to a beam directivity pattern in the range of about 130 to about 140 degrees; microphone R3 may be configured to a beam directivity pattern in the range of about 145 to about 155 degrees. Each microphone in each array should have a beam directivity pattern such that the resulting cross-beams between the left array and the right array intersect at the location of the user's mouth. General reference microphone X1 may have a wide beam with an omni directional or unidirectional pickup pattern, for example in the range of about 180 degrees to 360 degrees, to receive ambient and environmental acoustic frequencies in the vicinity of the user. General reference microphone X1 may be located on the chest area or back area of the wearable garment. Two general reference microphones may be incorporated into the system, one on the chest and one on the back of the wearable garment, such that the general reference microphones may receive ambient and environmental acoustic frequencies in a front vicinity and a rear vicinity of the user, with the difference being due to differing omni or directional pickup patterns and the acoustic shadowing effects of the user's body.

FIG. 7 is system diagram of a wearable bi-directional microphone array system 700. According to an embodiment, system 700 is operable to receive and process a user's voice to render a high-definition digital audio output with limited interference from ambient or environmental audio frequencies in the vicinity of the user. In a nearfield embodiment, system 700 can be utilized in high ambient noise environments, for example an airport tarmac, to render a high-definition digital audio output of the user's voice to one or more audio output devices. In a bi-directional embodiment, system 100 may also be configured to receive oncoming far field sound waves and process an audio output to a user's ear through one or more audio output devices, such as a hearing aid or headphone.

According to an embodiment, system 700 receives a source acoustic input 728 to a left sensor array 702 and a right sensor array 704. Left sensor array 702 and a right sensor array 704 are comprised of a plurality of individual microphones, but may also be comprised of acoustic sensors, acoustic renderers, or digital transducers. Left sensor array 702 and a right sensor array 704 are housed in a wearable garment 732 and located on a left shoulder portion and a right shoulder portion thereof. Wearable garment 732 may be a vest, jacket, shirt, or other wearable garment that can be worn around the shoulders of a user. Left sensor array 702 and right sensor array 704 are calibrated such that a pickup beam from each individual microphone in each array intersects at the location of the user's mouth, thereby improving the quality of the audio output of the user's voice in high-noise environments as compared to non-intersecting beams. Left sensor array 702 and right sensor array 704 apply a pre-calibrated time delay 708 (as discussed above) to ensure the arriving acoustic input 702 from the user's voice is received in-phase across all microphones in left sensor array 702 and right sensor array 704. Left sensor array 702 and right sensor array 704 combine the input signal received across each microphone in the array to produce a first stage beamformed audio output directly to a system bus 726. System bus 726 may be comprised of an array of conductive fibers operably connected to each individual microphone in left sensor array 702 and right sensor array 704, and operably connected to an output connector and/or cable connecting to audio processing module (APM) 734. System 700 receives an ambient acoustic input 730 to reference microphone 706. Reference microphone 706 has a directivity pattern calibrated to pick up near field and far field acoustic frequencies reaching the vicinity of the user. Reference microphone 706 is calibrated such that ambient acoustic input 730 is representative of the sounds in the user's environment. Reference microphone 706 delivers a signal output to APM 734 via system bus 726.

System bus 726 delivers a first stage beamformed audio from left sensor array 702 and right sensor array 704, and to APM 734. APM 734 may execute a first stage of signal combination 712 by analyzing the reference frequencies from reference microphone 706, and removing those frequencies from the first stage beamformed audio from left sensor array 702 and right sensor array 704. The source input frequencies from left sensor array 702 and right sensor array 704 are combined in signal combination processing 712, and the combined audio is constructively beamformed in a second beamforming stage 714. Audio from second stage beamforming 714 is further processed to apply gain control 718 and audio power amplifier 720 to render a digital audio output 722.

Alternatively, signal combination 712 may function to combine signal input from left sensor array 702, right sensor array 704 and reference microphone 706, and deliver combined frequencies to signal separation module 716. Signal separation module 716 may perform one or more blind source separation algorithms to analyze the frequency(ies) of the target source, and deconstructive separate the undesired frequencies from the combined audio. The desired frequencies are further processed to apply gain control 718 and audio power amplifier 720 to render a digital audio output 722. Digital audio output 722 may be output to a digital audio output device 724. Digital audio output device 724 may include hearing aids, wireless headphones, wired headphones, assisted listening devices, ear buds, cellular phones, smart phones, tablet computers, wireless speakers, laptop computers, desktop computers, and the like.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. An apparatus comprising:

a wearable garment having a left shoulder portion and a right shoulder portion;

a first plurality of sensors disposed on the left shoulder portion of the wearable garment, the first plurality of sensors comprising an array;

a second plurality of sensors disposed on the right shoulder portion of the wearable garment, the second plurality of sensors comprising an array; and, an audio processing module, the audio processing module being operable to combine a first stage beamformed audio input from the first plurality of sensors and a first stage beamformed audio input from the second plurality of sensors to render a digital audio output.

2. The apparatus of claim 1 wherein the plurality of sensors is selected from the group consisting of microphones, acoustic sensors, acoustic renderers, and digital transducers.

3. The apparatus of claim 1 wherein the wearable garment further comprises an array of conductive fibers operably interconnected to the first plurality of sensors and the second plurality of sensors.

4. The apparatus of claim 1 further comprising an output control interface operably engaged with the audio processing module.

5. The apparatus of claim 1 wherein each sensor in the first plurality of sensors and the second plurality of sensors is operable to calibrate a directivity pattern according to the directionality of a common signal between overlapping beams among other sensors in the first plurality of sensors and the second plurality of sensors in response to a user's voice audio input.

6. The apparatus of claim 1 wherein each sensor in the first plurality of sensors and the second plurality of sensors is operable to calibrate a time delay according to the time delay of a common signal between overlapping beams among other sensors in the first plurality of sensors and the second plurality of sensors in response to a user's voice audio input.

7. The apparatus of claim 1 further comprising a reference microphone disposed on a portion of the wearable garment, the reference microphone having a directivity pattern operable to receive an acoustic input from one or more ambient sound sources.

8. The apparatus of claim 1 further comprising an output device operably engaged with the audio processing module, the output device being selected from the group consisting of hearing aids, wireless headphones, wired headphones, assisted listening devices, ear buds, cellular phones, smart phones, tablet computers, wireless speakers, laptop computers, and desktop computers.

9. The apparatus of claim 7 wherein the audio processing module is further operable to process reference frequencies from the reference microphone and remove reference frequencies from the first stage beamformed audio input.

10. An apparatus comprising:

a wearable garment having a left shoulder portion and a right shoulder portion;

a first plurality of sensors comprising an array disposed on the left shoulder portion of the wearable garment;

a second plurality of sensors comprising an array disposed on the right shoulder portion of the wearable garment, each sensor in the first plurality of sensors and the second plurality of sensors having an individually calibrated directivity pattern and time delay corresponding to a source location of a user's voice; and, an audio processing module operably engaged with the first plurality of sensors and the second plurality of sensors through an electrical bus, wherein the audio processing module comprises one or more processors operable to combine a first stage beamformed audio input from the first plurality of sensors and a first stage beamformed audio input from the second plurality of sensors to render a digital audio output.

11. The apparatus of claim 10 wherein the first plurality of sensors and the second plurality of sensors are selected from the group consisting of microphones, acoustic sensors, acoustic renderers, and digital transducers.

12. The apparatus of claim 10 further comprising an output control interface operably engaged with the audio processing module.

13. The apparatus of claim 10 further comprising a reference microphone disposed on a portion of the wearable garment, the reference microphone having a directivity pattern operable to receive an acoustic input from one or more ambient sound sources.

14. The apparatus of claim 10 further comprising an output device operably engaged with the audio processing module, the output device being selected from the group consisting of hearing aids, wireless headphones, wired headphones, assisted listening devices, ear buds, cellular phones, smart phones, tablet computers, wireless speakers, laptop computers, and desktop computers.

15. The apparatus of claim 13 wherein the audio processing module is further operable to process reference frequencies from the reference microphone and remove reference frequencies from the first stage beamformed audio input to render a second stage beamformed audio output.

16. A directional microphone array system comprising:

a wearable garment having a left shoulder portion and a right shoulder portion;

a first plurality of sensors comprising an array disposed on the left shoulder portion of the wearable garment;

a second plurality of sensors comprising an array disposed on the right shoulder portion of the wearable garment, each sensor in the first plurality of sensors and the second plurality of sensors having an individually calibrated directivity pattern and time delay corresponding to a source location of a user's voice;

a reference microphone disposed on a portion of the wearable garment, the reference microphone having a directivity pattern operable to receive an acoustic input from one or more ambient sound sources;

an audio processing module operably engaged with the first plurality of sensors, the second plurality of sensors, and the reference microphone through an electrical bus, wherein the audio processing module comprises beamforming and signal separation circuitry, and one or more processors; and, an output device operably engaged with the audio processing module.

17. The apparatus of claim 16 wherein the first plurality of sensors and the second plurality of sensors are selected from the group consisting of microphones, acoustic sensors, acoustic renderers, and digital transducers.

18. The apparatus of claim 16 wherein the output device is selected from the group consisting of hearing aids, wireless headphones, wired headphones, assisted listening devices, ear buds, cellular phones, smart phones, tablet computers, wireless speakers, laptop computers, and desktop computers.

19. The apparatus of claim 16 wherein the wearable garment further comprises an array of conductive fibers.

20. The apparatus of claim 19 wherein the first plurality of sensors and the second plurality of sensors are operably engaged with the array of conductive fibers.

* * * * *